US011346617B2

(12) United States Patent
Kaibuchi et al.

(10) Patent No.: US 11,346,617 B2
(45) Date of Patent: May 31, 2022

(54) WICK STRUCTURE AND HEAT PIPE ACCOMMODATING WICK STRUCTURE

(71) Applicant: FURUKAWA ELECTRIC CO., LTD., Tokyo (JP)

(72) Inventors: Tomomi Kaibuchi, Tokyo (JP); Tomoaki Toratani, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 89 days.

(21) Appl. No.: 16/752,481

(22) Filed: Jan. 24, 2020

(65) Prior Publication Data

US 2020/0158447 A1 May 21, 2020

Related U.S. Application Data

(63) Continuation of application No. PCT/JP2018/028169, filed on Jul. 27, 2018.

(30) Foreign Application Priority Data

Jul. 28, 2017 (JP) ..... JP2017-145994
Jun. 29, 2018 (JP) ..... JP2018-123795

(51) Int. Cl.
*F28F 3/04* (2006.01)
*F28D 15/02* (2006.01)
(Continued)

(52) U.S. Cl.
CPC ..... *F28F 3/048* (2013.01); *F28D 15/0233* (2013.01); *F28D 15/046* (2013.01); *F28F 3/12* (2013.01); *F28F 2210/10* (2013.01)

(58) Field of Classification Search
CPC ..... F28F 3/04; F28F 3/048; F28F 3/06; F28F 3/12; F28F 2210/10; F28D 15/02; F28D 15/0233; F28D 15/04; F28D 15/046
(Continued)

(56) References Cited

U.S. PATENT DOCUMENTS 7,652,885 B2 * 1/2010 Tomioka ..... G06F 1/203 361/700
7,845,394 B2 * 12/2010 Chang ..... F28D 15/046 165/104.26
(Continued)

FOREIGN PATENT DOCUMENTS

CN 1782650 A 6/2006
CN 101354220 A 1/2009
(Continued)

OTHER PUBLICATIONS

[English Translation] 3rd Office Action dated Jun. 9, 2021 for CN Application No. 201880044305.9.
(Continued)

*Primary Examiner* — Len Tran
*Assistant Examiner* — Gustavo A Hincapie Serna
(74) *Attorney, Agent, or Firm* — Dorsey & Whitney LLP

(57) ABSTRACT

The present disclosure relates to a wick structure accommodated in a container of a heat pipe having plural foils and a structure holding portion for fixing the foils. The respective foils are held by the structure holding portion, whereby the foils are positions and arrange in parallel. The foil is connected to the other foils including the other adjacent foils via the structure holding portion.

14 Claims, 9 Drawing Sheets

(51) Int. Cl.
*F28D 15/04* (2006.01)
*F28F 3/12* (2006.01)

(58) Field of Classification Search
USPC ..... 165/170
See application file for complete search history.

(56) References Cited

U.S. PATENT DOCUMENTS

| | | | | |
|---|---|---|---|---|
| 9,551,538 | B2 * | 1/2017 | Honmura | F28D 15/0233 |
| 9,854,705 | B2 * | 12/2017 | Honmura | H05K 7/20336 |
| 9,897,392 | B2 * | 2/2018 | Wang | F28D 15/04 |
| 10,667,430 | B2 * | 5/2020 | Inagaki | H05K 7/20336 |
| 2003/0136551 | A1 | 7/2003 | Bakke | |
| 2006/0113662 | A1 | 6/2006 | Cepeda-rizo | |
| 2007/0012431 | A1 * | 1/2007 | Miyahara | F28D 15/0233 165/170 |
| 2010/0018678 | A1 * | 1/2010 | Siu | H01L 23/433 165/104.26 |
| 2010/0071880 | A1 * | 3/2010 | Kim | F28D 15/0266 165/104.26 |
| 2010/0212870 | A1 * | 8/2010 | Wu | H01L 23/427 165/104.26 |
| 2011/0024085 | A1 * | 2/2011 | Huang | F28D 15/0233 165/104.26 |
| 2012/0152498 | A1 * | 6/2012 | Lyon | H01L 23/473 165/104.31 |
| 2013/0037242 | A1 * | 2/2013 | Chen | F28D 15/0233 165/104.26 |
| 2013/0056178 | A1 * | 3/2013 | Matsunaga | H01L 23/427 165/104.21 |
| 2015/0007965 | A1 * | 1/2015 | Joshi | F28F 13/185 165/104.28 |
| 2016/0014931 | A1 * | 1/2016 | Hamakawa | H05K 7/20336 165/104.26 |
| 2017/0160018 | A1 * | 6/2017 | Tseng | F28D 15/046 |
| 2019/0132992 | A1 * | 5/2019 | Farshchian | F28D 15/04 |

FOREIGN PATENT DOCUMENTS

| | | | | | |
|---|---|---|---|---|---|
| CN | 101441045 | A | | 5/2009 | |
| JP | S55-100887 | U | | 12/1978 | |
| JP | 58-055687 | A | | 4/1983 | |
| JP | 03-117892 | A | | 5/1991 | |
| JP | 2002039693 | A | | 2/2002 | |
| JP | 2002318085 | A | * | 10/2002 | F28D 15/0233 |
| JP | 2002318085 | A | | 10/2002 | |
| JP | 2007093020 | A | | 4/2007 | |
| JP | 2007183021 | A | | 7/2007 | |
| JP | 2007183021 | A | * | 7/2007 | |
| JP | 2008505305 | A | | 2/2008 | |
| JP | 2012242009 | A | | 12/2012 | |
| JP | 2015045491 | A | | 3/2015 | |
| JP | 2015087089 | A | | 5/2015 | |
| JP | 2015087089 | A | * | 5/2015 | |
| JP | 2015169411 | A | | 9/2015 | |
| JP | 2016210413 | A | | 12/2016 | |
| WO | WO-2018198356 | A1 | * | 11/2018 | F28F 3/044 |

OTHER PUBLICATIONS

English translation of International Search Report and Written Opinion (EN translation of ISR only) for Application No. PCT/JP2018/028169, dated Oct. 16, 2018.

English translation of First Office Action for CN Application No. 201880044305.9, dated Sep. 1, 2020.

English translation of Office Action for CN App No. 201880044305.9, dated Mar. 8, 2021.

English translation of the Written Opinion for Application No. PT/JP2018/028169, dated Oct. 16, 2018.

International Preliminary Report on Patentability for Application No. PCT/JP2018/028169, dated Jan. 28, 2020.

[English Translation] Notice of Reasons for Refusal dated Mar. 16, 2022 for Japanese Patent Application No. 2018-567971; pp. all.

* cited by examiner

WICK STRUCTURE AND HEAT PIPE ACCOMMODATING WICK STRUCTURE

CROSS REFERENCE TO RELATED APPLICATIONS

The present application is a continuation application of International Patent Application No. PCT/JP2018/028169 filed on Jul. 27, 2018, which claims the benefit of Japanese Patent Application Nos. 2017-145994, filed on Jul. 28, 2017, and 2018-123795, filed on Jun. 29, 2018. The contents of these applications are incorporated herein by reference in their entirety.

BACKGROUND

Technical Field

The present disclosure relates to a wick structure capable of reducing a pressure loss of a working fluid, and a heat pipe that exhibits an excellent heat transport characteristic by accommodating the wick structure therein.

Background

Heat generation amounts of electronic parts such as semiconductor elements mounted on electric and electronic devices have been increased due to high density mounting caused by high performance, and cooling thereof has become more important. Heat pipes are sometimes used as a cooling method for electronic components.

As described above, since the amounts of heat generated by heat-generating elements have been increasing, further improvement in the heat transport characteristic of the heat pipes has been required. In order to further improve the heat transport characteristic, it is also considered to reduce a pressure loss when a working fluid enclosed in a heat pipe flows through a wick structure. Furthermore, since the wick structure is also required to have enhanced capillary force, it is also necessary to increase the surface area of an interface between the working fluid and the wick structure. However, when the surface area is increased in order to enhance the capillary force, there is a problem that the pressure loss when the working fluid flows through the wick structure increases.

Hence, there been proposed a heat pipe including an elongated hollow housing having a condensation end and an evaporation end, an undulating wick portion which is placed in the housing and has plural wedge-shaped capillaries with folded fins, and fluid placed in fluid communication with the undulating wick portion (National Publication of International Patent Application No. 2008-505305).

However, the heat pipe of National Publication of International Patent Application No. 2008-505305 in which the undulating wick portion having the folded fins is provided has a problem that the fin pitch of the wick portion cannot be made sufficiently small, and sufficient capillary force cannot be obtained. Furthermore, in the heat pipe of National Publication of International Patent Application No. 2008-505305, the shape of the wick portion which is an undulating shape, that is, a portion of the wick portion which is orthogonal to a longitudinal direction of the housing is not opened, and thus there is a problem that the working fluid which has changed in phase from a liquid phase to a gas phase suffers a pressure loss when flowing through the wick portion.

In addition, a sintered body of metal powder or a metal mesh may be used as a wick structure to be accommodated in a heat pipe. A predetermined capillary force can be easily obtained with the sintered body of metal powder or the metal mesh, but there is a problem that the working fluid which has changed in phase from the liquid phase to the gas phase may suffer a pressure loss when flowing through the sintered body of the metal powder or the metal mesh due to complexity of the shape of a flow path.

SUMMARY

In view of the above circumstances, the present disclosure has an object to provide a wick structure capable of reducing a pressure loss of a circulating working fluid without impairing a capillary force, and a heat pipe which exhibits an excellent heat transport characteristic by accommodating the wick structure therein.

The gist of components of the present disclosure is as follows.

[1] A wick structure to be accommodated inside a container of a heat pipe, the wick structure including a plurality of foils that are erected so as to be opposite to one another.

[2] The wick structure described in [1] in which a plurality of the foils are arranged side by side, and held by at least one structure holding portion, and the plurality of foils are connected via the structure holding portion.

[3] The wick structure described in [1] or [2] in which the structure holding portion may function as a fixing portion for connecting and fixing the plurality of foils to an inner surface of the container.

[4] The wick structure according to any one of [1] to [3] in which foil support portions are formed at upright base portions of the foils.

[5] The wick structure according to any one of [1] to [3] in which a porous member is provided to a part between the foils that are mutually adjacent to each other.

[6] The wick structure according to any one of [1] to [5] in which a material of the foils is metal, ceramics and/or carbon.

[7] The wick structure according to any one of [1] to [6] in which an aspect ratio of the plurality of foils is not less than 2 and not more than 1000.

[8] The wick structure according to any one of [1] to [7] in which an arithmetic average roughness (Ra) of surfaces of the foils is not less than 0.01 μm and not more than 1 μm.

[9] The wick structure according to any one of [1] to [8] in which thicknesses of the foils are not less than 1 μm and not more than 300 μm.

[10] The wick structure according to any one of [1] to [9] in which an inter-foil distance at upright base portions of the foils which are mutually adjacent to each other is not less than 2 μm and not more than 300 μm.

[11] The wick structure according to any one of [1] to [10] in which a cross-sectional area in a vertical direction to a longitudinal direction of the container is equal to 10% to 90% of a cross-sectional area of the container in the vertical direction to the longitudinal direction of the container.

[12] The wick structure according to any one of [3] to [11], wherein the fixing portion is a sintered body of metal powder, silver solder, or solder.

[13] A heat pipe in which the wick structure according to any one of [1] to [12] is accommodated.

[14] The heat pipe according to [13] in which the wick structure is installed at a heat receiving portion.

The wick structure is embodied such that plural foils are provided side by side, and a groove portion which is a gap portion is formed between adjacent foils.

In the specification, "aspect ratio" means the height (D) of a foil formed between the mutually adjacent foils relative to the thickness (T) of the foil at the upright base portions of the adjacent foil (the height (D) of the foil/the thickness (T) of the foil). Furthermore, when one foil 21 is divided into plural parts at a predetermined interval in the height direction by the structure holding portion 22, the height (D) of the foil 21 means a dimension from which the above interval is excluded. The foil pitch (L) is a distance between one surface of one foil and a surface of another foil which does not face the one foil, among foils adjacent to the one foil.

According to an aspect of the present disclosure, since the plurality of foils forming the wick structure is provided so as to be spaced apart from one another, the wick structure can reduce the pressure loss of the working fluid flowing among the plural foils without impairing the capillary force. As a result, the wick structure is accommodated in the heat pipe, so that it is possible to obtain a heat pipe exhibiting an excellent heat transport characteristic. In addition, the foils can also function as heat radiation fins, which also makes it possible to obtain a heat pipe exhibiting an excellent heat transport characteristic.

According to the aspect of the present disclosure, the plurality of foils forming the wick structure is provided so that the aspect ratio is not less than 2 and not more than 1000, so that the pressure loss of the working fluid can be reduced while the capillary force of the wick structure is further enhanced. As a result, it is possible to obtain a heat pipe that exhibits more excellent heat transport characteristic.

According to the aspect of the present disclosure, the material of the foils is metal, ceramics and/or carbon, so that thermal conductivity of the wick structure is enhanced. As a result, the heat transport characteristic of the heat pipe is further enhanced.

According to the aspect of the present disclosure, the arithmetic average roughness (Ra) of the surfaces of the foils is not less than 0.01 μm and not more than 1 μm, which can contribute to enhancement of the capillary force of the wick structure.

According to the aspect of the present disclosure, the cross-sectional area of the wick structure in the vertical direction to the longitudinal direction of the container is equal to 10% to 90% of the cross-sectional area of the container in the vertical direction to the longitudinal direction of the container, so that when the structure is accommodated in the heat pipe, flowability of the gas-phase working fluid and flowability of the liquid-phase working fluid which is a counter flow of the gas-phase working fluid can be enhanced in a well-balanced manner. Note that the wick structure of the present disclosure may be provided in the entire longitudinal direction of the container or may be provided in a part of the container in the longitudinal direction such as the heat receiving portion of the container. Accordingly, the ratio of the cross-sectional area is the ratio of the cross-sectional area at a portion of the container where the wick structure of the present disclosure is installed. The above "heat receiving portion" is a portion to which a heat-generating element as a cooling target is thermally connected to the container, and the liquid-phase working fluid changes in phase to gas phase mainly at the heat receiving portion.

DETAILED DESCRIPTION

Hereinafter, a wick structure according to a first embodiment of the present disclosure and a heat pipe in which the wick structure according to the first embodiment of the present disclosure is accommodated will be described with reference to the drawings. First, the heat pipe in which the wick structure is accommodated will be described.

Figure 3:
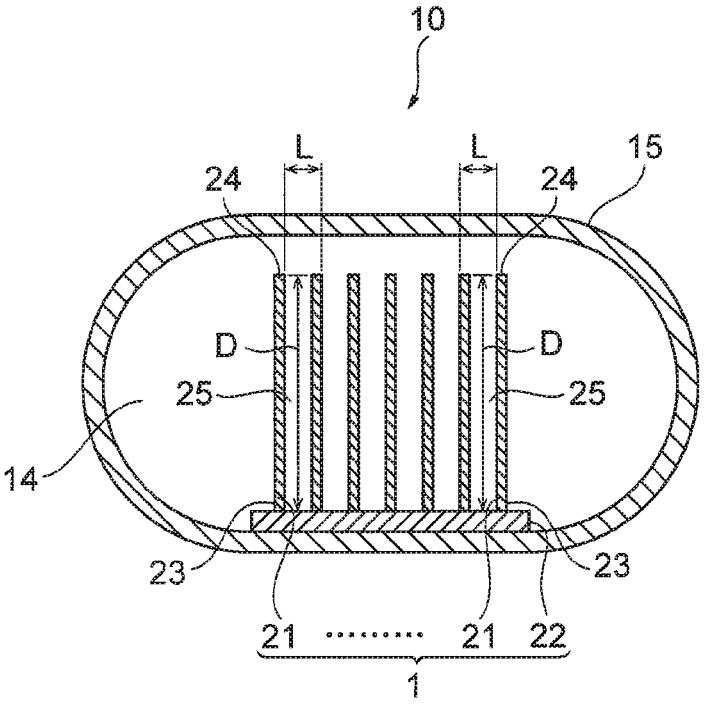
FIG. 3 is a front cross-sectional view of the wick structure according to the first embodiment of the present disclosure, which is accommodated in a heat pipe.
Figure 7:
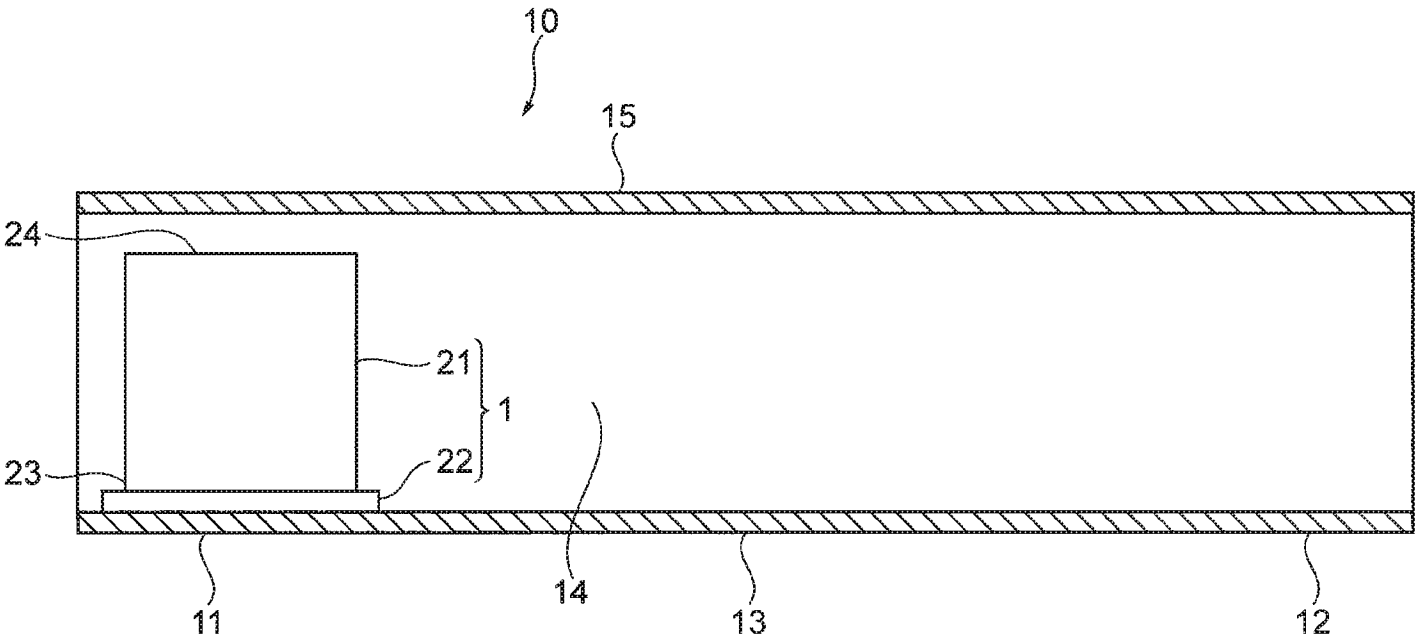
FIG. 7 is a side cross-sectional view of the wick structure according to the first embodiment of the present disclosure, which is accommodated in a heat pipe.

As shown in FIGS. 3 and 7, a wick structure 1 according to a first embodiment is accommodated inside a container 15 of a heat pipe 10. The container 15 is a tubular member. A working fluid (not shown) is enclosed inside the container 15.

The container 15 is a sealed tubing material. The sectional shape in a direction perpendicular to a longitudinal direction of the container 15 is not particularly limited, but it is a flattened shape in the case of the heat pipe 10. Furthermore, the shape of the container 15 in the longitudinal direction is not particularly limited, but it is substantially linear in the case of the heat pipe 10.

The dimension in a direction orthogonal to the longitudinal direction of the container 15 is not particularly limited, but, the lower limit value thereof is preferably equal to 1.0 mm or more, and particularly preferably 2.0 mm or more. The upper limit value of the dimension in the direction orthogonal to the longitudinal direction of the container 15 is not particularly limited, but 15 mm or less is preferable, and 10 mm or less is particularly preferable. The thickness of the container 15 is not particularly limited, but it is equal to, for example, 50 to 500 μm. A heat transport direction of the heat pipe 10 is the longitudinal direction of the container 15.

Figure 1:
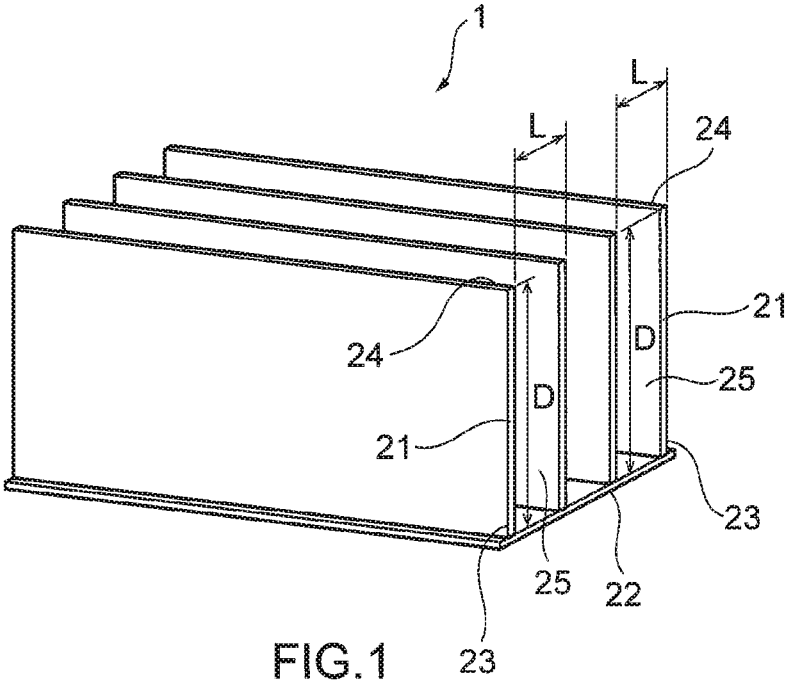
FIG. 1 is a perspective view showing an outline of a wick structure according to a first embodiment of the present disclosure.

As shown in FIGS. 1 and 3, the wick structure 1 accommodated in the container 15 of the heat pipe 10 has plural foils 21 and a structure holding portion 22 for fixing the foils 21. The respective foils 21, 21 . . . are held by the structure holding portion 22, whereby the foils 21 are positioned and arranged in parallel.

The foil 21 is connected to the other foils 21, 21 . . . including the other adjacent foils 21 via one structure holding portion 22. In FIGS. 1 and 3, the structure holding portion 22 is a planar portion extending along a bottom portion of an inner surface of the container 15. The structure holding portion 22 also functions as a fixing portion for connecting and fixing the plural foils 21, 21 . . . to the bottom portion of the inner surface of the container 15.

As shown in FIG. 3, the wick structure 1 is embodied such that the structure holding portion 22 is in direct contact with the inner surface of the container 15, but a sintered body of metal powder such as copper powder, silver solder, solder or the like (not shown) may be interposed between the structure holding portion 22 and the inner surface of the container 15. In this case, the structure holding portion 22 is fixed to the inner surface of the container 15 by a sintered body of metal powder such as copper powder, silver solder, solder or the like, and finally the wick structure 1 is fixed to the inner surface of the container 15 by a sintered body of metal power such as copper powder, silver solder, solder or the like. At this time, since the sintered body of metal powder such as copper powder has a capillary force, the sintered body of metal powder also functions as a wick portion for refluxing the working fluid in liquid phase to a position of the wick structure 1. In this case, there is a state where the liquid-phase working fluid exists between the structure holding portion 22 and the container, and the thermal resistance of the heat pipe 10 may become large. In order to improve this point, metal powder having a small particle size may be used for fixing the wick structure 1.

The shape of each of the foils 21, 21 . . . is a flat rectangular sheet shape (film-like shape). The respective foils 21, 21 . . . are erected in a vertical direction to the longitudinal direction of the container 15. In addition, the respective foils 21, 21 . . . extend in the vertical direction from the structure holding portion 22. Furthermore, the respective foils 21, 21 . . . are arranged side by side at a predetermined interval along a direction orthogonal to the longitudinal direction of the container 15. Furthermore, the foils 21, 21 . . . are arranged side by side at a predetermined interval along the structure holding portion 22. Therefore, the respective foils 21, 21 . . . are arranged to be separated from one another. In the wick structure 1 of the heat pipe 10, the respective foils 21, 21 . . . are arranged at substantially equal intervals at least at upright base portions erected from the structure holding portion 22. In FIGS. 1 and 3, the respective foils 21, 21 . . . are arranged at substantially equal intervals from the base portions erected from the structure holding portion 22 to free ends as tip end portions thereof. Furthermore, in the wick structure 1 of the heat pipe 10, the respective foils 21, 21 . . . are arranged side by side substantially in parallel to one another at least at the upright base portions erected from the structure holding portion 22. In FIGS. 1 and 3, the respective foils 21, 21 . . . are arranged side by side substantially in parallel to one another from the base portions erected from the structure holding portion 22 to the free end as the tip portion.

Since the foils 21 are erected in the vertical direction to the longitudinal direction of the container 15 as described above, there is a possibility that the foils 21 cannot maintain their flat shapes and thus may be deformed in shape in the vertical direction, so that bent portions are formed in some of the foils 21 or the like. Therefore, the adjacent foils 21 may be close to each other at a shorter interval at a portion on the free end side than that at the upright base portions erected from the structure holding portion 22, or may contact each other.

As shown in FIG. 7, the respective foils 21, 21 . . . are embodied so as to extend along the longitudinal direction of the container 15 from the configuration of the foils 21 described above. In the heat pipe 10, the wick structure 1 is arranged at one end portion 11 of the container 15, and the wick structure 1 is not arranged at a center portion 13 of the container 15 and at another end portion 12 opposite to the one end portion 11.

One end side portions 23 of the respective foils 21, 21 . . . in a height direction are held by the structure holding portion 22, whereby the respective foils 21, 21 . . . are positioned. Accordingly, one end side portions 23 of the foils 21 serve as the upright base portions erected from the structure holding portion 22. That is, the respective foils 21, 21 . . . are embodied to be erected from the structure holding portion 22, and the respective foils 21, 21 . . . are connected to one another via the structure holding portion 22.

On the other hand, other end side portions 24 opposite to the one end side portions 23 of the foils 21 are not fixed, but serve as free ends. In the wick structure 1, the tips of the other end side portions 24 of the foils 21 are not in contact with the inner surface of the container 15. Therefore, a space between the other end side portions 24 of the mutually adjacent foils 21 serves as an opened portion. From the foregoing, a groove portion 25 which is a gap portion is formed between the mutually adjacent foils 21. Since the surface shape of the foil 21 is flat, that is, planar, and thus the cross-sectional shape of the groove 25 in the direction orthogonal to the longitudinal direction of the heat pipe 10 is rectangular. Furthermore, the groove portion 25 extends between the mutually adjacent foils 21 along the longitudinal direction of the heat pipe 10. Furthermore, the surface of the structure holding portion 22 corresponds to bottom portions of the groove portions 25. Therefore, the height (D) of the foil 21 corresponds to the distance from the surface of the structure holding portion 22 to the other end side portion 24 of the foil 21.

In the wick structure 1, the opened portion is provided on the side of the other end side portion 24 of the foil 21 and the cross-sectional shape of the groove 25 is rectangular, so that the working fluid which has changed in phase from the liquid phase to the gas phase in the groove portions 25 is smoothly discharged from the groove portions 25 to the outside of the wick structure 1 via the opened portions between the other end side portions 24. Accordingly, when the working fluid having changed in phase from the liquid phase to the gas phase in the groove portions 25 is discharged to the outside of the wick structure 1, the pressure loss can be reduced and consequently flow of the gas-phase working fluid in the container 15 can be smoothened.

Note that the other end side portions 24 of the foils 21 may be non-free ends or fixed ends contacting the inner surface of the container 15 instead of the foregoing free ends which are not in contact with the inner surface of the container 15. The respective foils 21, 21 . . . are arranged to be spaced apart from one another. Accordingly, even when the other end side portions 24 of the foils 21 are in contact with the inner surface of the container 15, the working fluid which has changed in phase from the liquid phase to the gas phase in the groove portions 25 is smoothly discharged from the groove portions 25 to the outside of the wick structure 1 via the spaced portion between the foil 21 and the foil 21.

In the wick structure 1, the aspect ratio of the plural foils 21 is not particularly limited, but the plural foils 21 are arranged so that the aspect ratio thereof is, for example, not less than 2 and not more than 1000. "Aspect ratio" means the height (D) of a foil 21 formed between mutually adjacent foils 21 relative to the thickness (T) of the foil at the upright base portions (one end side portions 23) of the mutually adjacent foils 21 (the height of the foil (D)/the thickness (T) of the foil). Note that as shown in FIGS. 1 and 3, the foil pitch (L) is a distance between one surface of one foil 21 and a surface of another which does not face the one foil 21, among foils 21 adjacent to the one foil 21. The respective foils 21, 21 . . . are arranged so that the aspect ratio is not less than 2 and not more than 1000, whereby the pressure loss of the working fluid flowing through the wick structure 1 can be reduced while enhancing the capillary force. In addition, the wick structure 1 is accommodated in the container 15, whereby it is possible to obtain the heat pipe 10 exhibiting an excellent heat transport characteristic. Note that when deformation occurs in the shapes of foils 21 of the wick structure 1 because the sheet-shaped (film-shaped) foils 21 are erected upright and thus cannot maintain flat shapes, so that the foils 21 have bent portions or the like, the foregoing aspect ratio is calculated on the assumption of a shape from which deformation is eliminated. Furthermore, in one aspect in which one foil 21 is divided into plural pieces at a predetermined interval in the height direction by the structure holding portion 22, the height (D) of the foil 21 means a dimension from which the foregoing intervals are excluded.

As described above, it is preferable that the aspect ratio of the foils 21 is, for example, not less than 2 and not more than 1000, and from the viewpoint of further enhancing the capillary force of the wick structure 1 to further smoothen reflux of the liquid-phase working fluid, the lower limit value of the aspect ratio is more preferably 70, further preferably 80, and particularly preferably 90. In addition, from the viewpoint of surely reducing the pressure loss when the working fluid having changed in phase from the liquid phase to the gas phase flows through the wick structure 1, and obtaining a mechanical strength of the foils 21, with respect to the upper limit value of the aspect ratio of the foils 21, 480 is more preferable, and 330 is particularly preferable.

Furthermore, the aspect ratio of the foil 21 may be the same aspect ratio or different aspect ratios among the respective foils 21, 21 . . . .

An arithmetic mean roughness (Ra) of the surface of the foil 21 is not particularly limited, and the surface may be a smooth surface. However, with respect to the lower limit value of the arithmetic mean roughness, from the viewpoint of contributing to the enhancement of the capillary force, 0.01 μm is preferable, and 0.02 μm is particularly preferable. On the other hand, the upper limit value of the arithmetic mean roughness (Ra) of the surface of the foil 21 is not particularly limited, but 1.0 μm is preferable, and 0.5 μm is particularly preferable from the viewpoint of smooth flow of the gas-phase working fluid.

Figure 12:
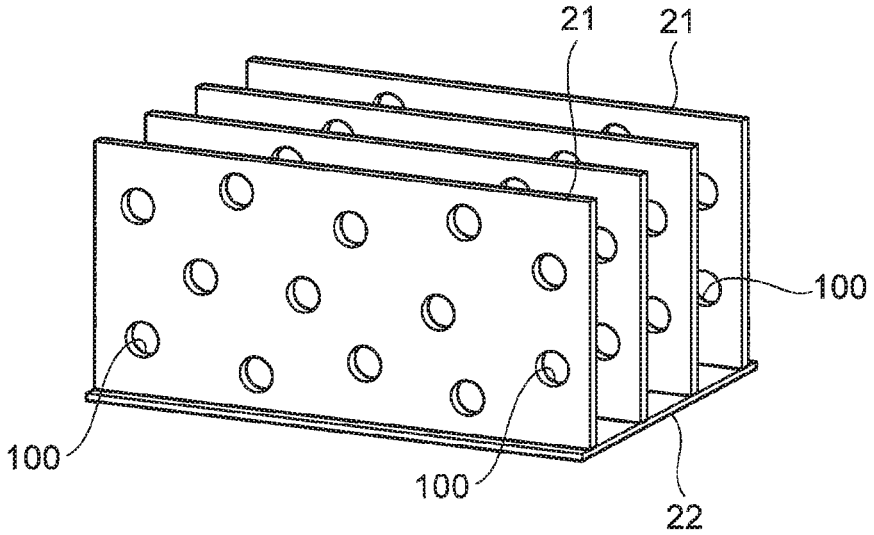
FIG. 12 is a diagram showing a wick structure according to another embodiment of the present disclosure.

As shown in FIG. 12, the foils 21 may be provided with penetration holes 100 penetrating in the thickness direction thereof as required. Furthermore, structures such as protruding parts protruding in the thickness direction, recessed parts recessed in the thickness direction may be formed on the surfaces of the foils 21 as required. Furthermore, the penetration hole 100 of a foil 21 and the penetration hole 100 of another adjacent foil 21 are communicated with each other by a pipe portion to form a through-hole, so that the adjacent foils 21 may be connected to each other.

The thickness (T) of the foils 21 is not particularly limited, but with respect to the lower limit value of the thickness (T), from the viewpoint of mechanical strength, 1 μm is preferably, and 2 μm is particularly preferable. On the other hand, with respect to the upper limit value of the thickness (T) of the foils 21, 300 μm is preferable, 200 μm is more preferable, and 100 μm is particularly preferable from the viewpoint of enhancing the aspect ratio while securing the width of the grooves 25. Also, when the thickness (T) of the foils 21 is not more than 6 μm, excellent handling performance cannot be obtained, but from the viewpoint of enhancing the capillary force of the wick structure 1, it is preferable that the thickness (T) of the foils 21 is small.

The cross-sectional area of the wick structure 1 in the vertical direction to the longitudinal direction of the container 15 is not particularly limited, but 10% or more of the cross-sectional area of the container 15 in the vertical direction to the longitudinal direction of the container 15 is preferable, and 20% or more is particularly preferable from the viewpoint of smoothly refluxing the liquid-phase working fluid to one end portion 11 of the container 15. On the other hand, with respect to the cross-sectional area of the wick structure 1 in the vertical direction to the longitudinal direction of the container 15, 90% or less of the cross-sectional area of the container 15 in the vertical direction to the longitudinal direction of the container 15 is preferable, and 80% or less is particularly preferable from the viewpoint of causing the working fluid having changed in phase from the liquid phase to the gas phase in the wick structure 1 to smoothly flow in a direction from the one end portion 11 to the other end portion 12 of the container 15.

The foil pitch (L) at the base portions (one end side portions 23) of the mutually adjacent foils 21 erected from the structure holding portion 22 can be appropriately set according to the aspect ratio of the plural foils 21. However, with respect to the lower limit value of the foil pitch (L), 2 μm is preferable, 10 μm is more preferable, and 20 μm is particularly preferable from the viewpoint of securing the width of the groove 25 (that is, the distance between the mutually adjacent foils 21) to ensure flowability of the working fluid, that is, surely reduce the pressure loss. On the other hand, with respect to the upper limit value of the foil pitch (L), 300 μm is preferable, 100 μm is more preferable, and 80 μm is particularly preferable from the viewpoint of surely preventing decrease in capillary force.

The material of the foils 21 is not particularly limited, but for example, metal (that is, metal foils) such as copper and copper alloy from the viewpoint of excellent thermal conductivity, aluminum and aluminum alloy from the view point of lightness, and stainless steel from the viewpoint of strength can be used. in addition to the above various metals, ceramics (including glass) and carbon materials (for example, graphite, diamond, etc.) from the viewpoint of thermal conductivity can be used as the material of the foils 21. Furthermore, metal (copper, copper alloy, etc.), ceramics, and carbon materials can be recited as the material of the structure holding portion 22.

Furthermore, the structure holding portion 22 may be extended not only to a bottom portion side of the inner surface of the container 15 of the wick structure 1, but also to a side surface portion of the wick structure 1 as required, thereby causing the structure holding portion 22 to function as a container for accommodating the wick structure 1.

The material of the container 15 is not particularly limited, but for example, copper and copper alloy from the viewpoint of excellent thermal conductivity, aluminum and aluminum alloy from the viewpoint of lightness, and stainless steel, etc. from the viewpoint of strength can be used. In addition, tin, tin alloy, titanium, titanium alloy, nickel, nickel alloy, etc. may be used according to a use condition. Furthermore, the working fluid enclosed in the container 15 can be appropriately selected according to compatibility with the material of the container 15, and for example, water, substitute CFCs, perfluorocarbon, cyclopentane and the like may be recited.

Next, a mechanism of heat transport of the heat pipe 10 in which the wick structure 1 according to the first embodiment of the present disclosure is accommodated will be described with reference to FIGS. 1, 3, and 7. Here, a case where one end portion 11 of the container 15 having the wick structure 1 arranged therein serves as a heat receiving portion and the other end portion 12 serves as a heat radiating portion will be described as an example.

First, a heat-generating element (not shown) is thermally connected to a side of the container 15 on which the structure holding portion 22 of the wick structure 1 is arranged. The structure holding portion 22 of the wick structure 1 contacts the inner surface of the container 15. When the heat pipe 10 receives heat from the heat-generating element at the heat receiving portion, heat is transferred from the container 15 of the heat pipe 10 to the structure holding portion 22 of the wick structure 1. The heat transferred to the structure holding portion 22 is transferred from the structure holding portion 22 to the foils 21, and the liquid-phase working fluid changes in phase into the gas phase inside the wick structure 1 (the groove portions 25). The working fluid which has changed in phase to the gas phase in the groove portions 25 of the wick structure 1 moves to an upper side in a gravity direction (a direction from the upright base portions of the foils 21 to the other end side portions 24 of the foils 21), and is discharged to the outside of the wick structure 1 from the groove portions 25 via the opened portions formed between the other end side portions 24 of the mutually adjacent foils 21. The internal space of the container 15 functions as a vapor flow path 14 through which the gas-phase working fluid flows. The gas-phase working fluid discharged to the outside of the wick structure 1 flows in the longitudinal direction of the container 15 from the heat receiving portion to the heat radiating portion in the vapor flow path 14, so that the heat from the heat-generating element is transported from the heat receiving portion to the heat radiating portion. The heat from the heat-generating element which is transported from the heat receiving portion to the heat radiating portion is released as latent heat by the phase change of the gas-phase working fluid to the liquid phase at the heat radiating portion provided with heat exchanging means as required. The latent heat released at the heat radiating portion is discharged from the heat radiating portion to an external environment of the heat pipe 10. The working fluid which has changed in phase from the gas phase to the liquid phase at the heat radiating portion is taken into a wick portion (not shown) such as plural fine grooves or a sintered body of metal powder provided on the inner surface of the container 15, and is returned from the heat radiating portion to the heat receiving portion by the capillary force of the wick portion.

In the wick structure 1 according to the first embodiment, the plural foils 21 are arranged so as to be spaced apart from one another, so that the wick structure 1 can reduce the pressure loss of the working fluid flowing in the wick structure 1 without impairing the capillary force. Therefore, the wick structure 1 is excellent in the flowability of the gas-phase working fluid inside the wick structure 1 while maintaining the reflux characteristic of the liquid-phase working fluid from the heat radiating portion to the heat receiving portion. Therefore, the wick structure 1 is accommodated in the container 15, whereby it is possible to obtain the heat pipe 10 exhibiting an excellent heat transport characteristic.

Next, an example of a method for manufacturing the wick structure 1 according to the first embodiment of the present disclosure will be described. As the method of manufacturing the wick structure 1, the wick structure 1 can be manufactured with a 3D printer or metal powder molding. Deep engraving is difficult to realize a structure having a high aspect ratio like the wick structure of the present disclosure by etching, but it is possible in the 3D printer to manufacture a high aspect-ratio structure by laminating fine portions. A solution photocuring lamination method, a melting lamination method, a material extrusion photocuring method, a powder bed melting bonding method, or the like may be adopted for the 3D printer.

Figure 5:
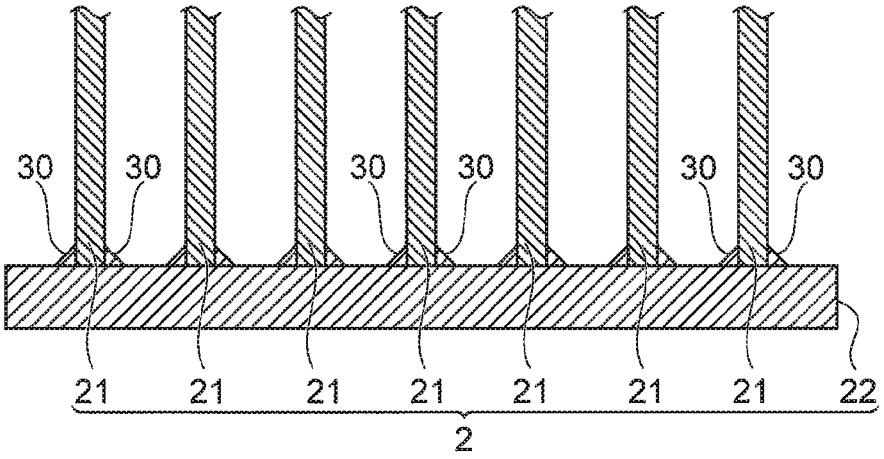
FIG. 5 is a diagram showing a wick structure according to a second embodiment of the present disclosure.

Next, a wick structure according to another embodiment of the present disclosure will be described. The same components as those of the wick structure according to the first embodiment will be described while represented by the same reference signs. The wick structure 2 according to the second embodiment may be a wick structure 2 in which foil support portions 30 are further formed, as required, along the upright base portions of the foils 21 as shown in FIG. 5. The foil support portion 30 is convex-shaped, for example. By providing the foil support portions 30, the foils 21 are stably held on the structure holding portion 22. The foils 21 and the structure holding portion 22 are not necessarily chemically bonded completely in some cases, and in such a case, the holding effect based on the foil support portions 30 becomes more important.

Figure 6:
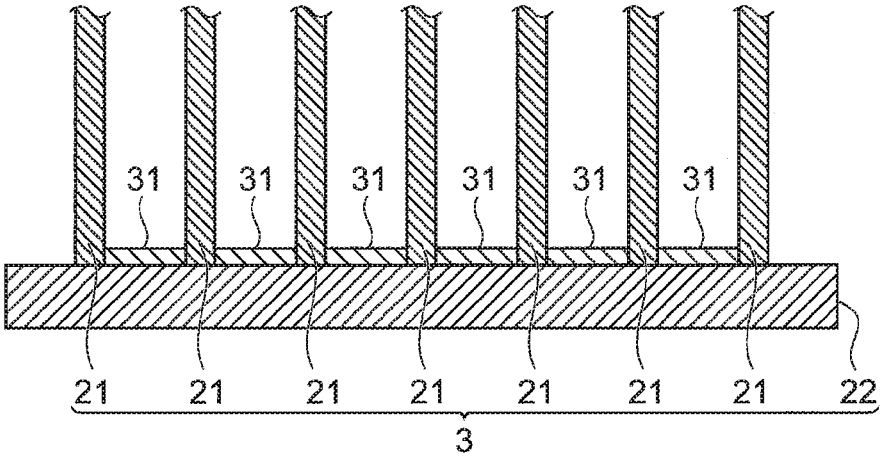
FIG. 6 is a diagram showing a wick structure according to a third embodiment of the present disclosure.

As shown in FIG. 6, the wick structure 2 according to the second embodiment may be a wick structure 3 in which porous members 31 such as mesh materials of metal, sintered bodies of metal powder, or sintered bodies of metallic short fibers are further provided, as required, among mutually adjacent foils 21. In the wick structure 3, the porous members 31 are provided on the surface of the structure holding portion 22. By providing the porous members 31, the capillary force and the heat transfer characteristic of the wick structure 3 are further enhanced.

In the wick structure 1 according to the first embodiment, the respective foils 21, 21 . . . are arranged at substantially equal intervals, but the respective foils 21, 21 . . . may be arranged at different intervals.

In the wick structure 1 according to the first embodiment, the respective foils 21, 21 . . . have substantially the same height, and the positions of the tip portions of the respective foils 21, 21 . . . are substantially the same. However, the heights of the foils 21 may differ among at least some of the foils 21, and the positions of the tip portions of the foils 21 may be different among at least some foils. Since the working fluid changes in phase from the liquid phase to the gas phase mainly at the heat receiving portion, and thus enhancement of the heats transport characteristic may be expected by embodying the wick structure 1 so that the height of the foils 21 decreases from the heat radiating portion to the heat receiving portion.

In the wick structure 1 according to the first embodiment, the respective foils 21, 21 . . . are erected in the vertical direction to the longitudinal direction of the container 15, but the erecting direction of the foils 21, that is, the direction from the one end side portions 23 to the other end side portions 24 of the foils 21 is not particularly limited. For example, when the wick structure 1 is accommodated in a planar type heat pipe, the wick structure 1 may be embodied so that the direction from the one end side portions 23 to the other end side portions 24 of the foils 21 is along the plane direction of the planar type heat pipe. In this case, the planar portions of the foils 21 extend along the plane direction of the planar type heat pipe.

Furthermore, in a flat type container 10, the wick structure 1 may be embodied so that the direction from the one end side portions 23 to the other end side portions 24 of the foils 21 may be along the flat portion direction of the flat type heat pipe. In this case, the planar portions of the foils 21 extend along the direction of the flat portion of the flat type heat pipe.

The wick structure 1 according to the first embodiment is arranged at one end portion 11 of the container 15, and the wick structure 1 is arranged at neither the center portion 13 nor the other end portion 12. Alternatively, the wick structure 1 may also be arranged at the center portion 13 and/or the other end portion 12.

In the heat pipe 10 in which the wick structure 1 according to the first embodiment is accommodated, the cross-sectional shape in the direction orthogonal to the longitudinal direction of the container 15 is a flat shape. However, the container 15 may not be flattened, and the cross-sectional shape thereof may be, for example, a circular shape, a rounded rectangular shape, a polygonal shape, or the like. In the heat pipe 10 in which the wick structure 1 according to the first embodiment is accommodated, the shape of the container 15 in the longitudinal direction is substantially linear. Alternatively, the shape of the container 15 may be a shape having a curved portion such as a U-shape or an L-shape, etc.

Furthermore, in the wick structure 1 according to the first embodiment, the respective foils 21, 21 . . . are arranged side by side substantially in parallel to one another at least at the upright base portions erected from the structure holding portion 22. However, the arrangement of the foils 21, 21 . . . is not limited to a substantially parallel arrangement, but may be randomly arranged, for example. Furthermore, the foils 21, 21 . . . may be arranged radially in a plan view, and the foils 21 may be arranged to be continuous with one another in an arc shape.

In the wick structure 1 according to the first embodiment, the surface shape of the foil 21 is a planar shape, but instead of the planar shape, the surface may be a shape having a curved surface, a shape having a surface with steps, a shape having an undulating surface or the like.

Figure 4:
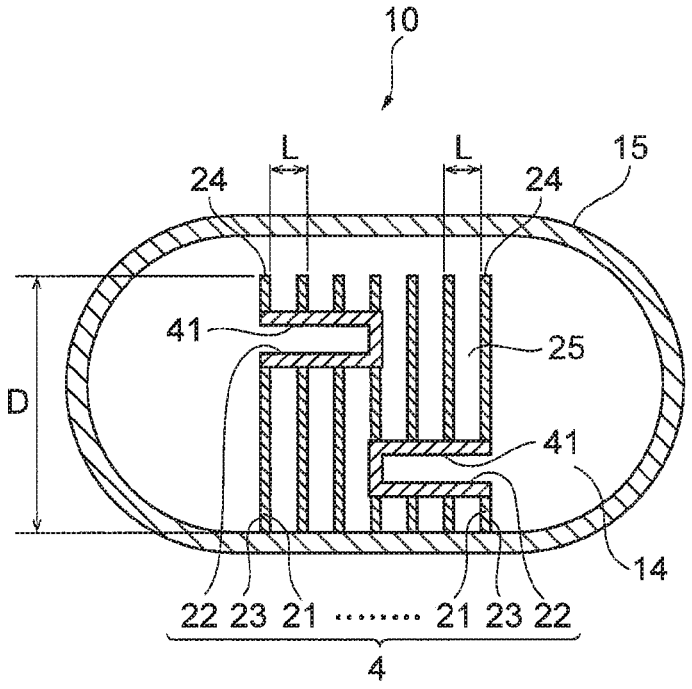
FIG. 4 is a front cross-sectional view of a wick structure according to a fourth embodiment of the present disclosure, which is accommodated in a heat pipe.

Furthermore, the position of the structure holding portion 22 is not particularly limited. For example, as shown in the wick structure 4 according to a fourth embodiment of FIG. 4, the respective foils 21, 21 . . . may be divided into plural parts at a predetermined interval by plural structure holding portions 22. Note that in the wick structure 4 of FIG. 4, the same reference signs are used for the same components as those of the wick structures 1, 2, 3.

In the wick structure 4, two U-shaped structure holding portions 22 are provided. With respect to the respective foils 21, 21 . . . , the structure holding portions 22 are provided between the one end side portions 23 and the other end side portions 24 of the respective foils 21, 21 . . . , and each of the foils 21, 21 . . . is divided into two or three parts in the height direction of the foil 21. In the wick structure 4, a notch 41 which is rectangular in front view is formed by each structure holding portion 22.

A foil 21 is connected to the respective foils 21, 21 . . . including adjacent other foils via at least one of the plural (two in the wick structure 4) structure holding portions 22. Note that in the wick structure 4, the structure holding portion 22 is provided to neither the one end side portions 23 nor the other end side portions 24 of the foils 21.

In the wick structure 4 as well, the plural foils 21, 21 . . . are provided so as to be spaced apart from one another, whereby the pressure loss of the working fluid flowing among the plural foils 21, 21 . . . can be reduced without impairing the capillary force. Furthermore, the heat pipe 10 exhibiting an excellent heat transport characteristic can be obtained in the point that the foils 21 can also exhibit a function as radiation fins.

Figure 2:
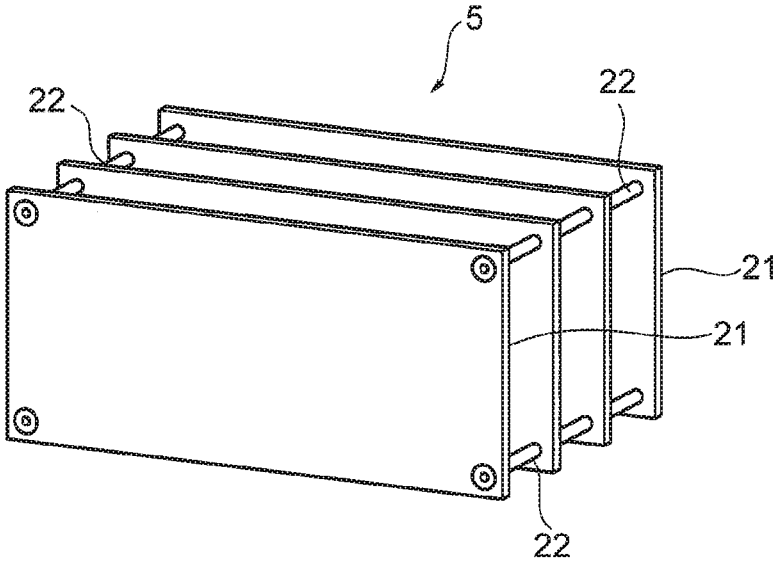
FIG. 2 is a perspective view showing an outline of a wick structure according to a fifth embodiment of the present disclosure.

Next, a wick structure according to a fifth embodiment of the present disclosure will be described. The same components as those of the wick structures according to the first to fourth embodiments will be described while using the same reference signs. In the wick structures 1 according to the first to third embodiments, the structure holding portion 22 is a planar portion extending along the bottom portion of the inner surface of the container 15. In place of this portion, in the wick structure 5 according to the fifth embodiment, the structure holding portion 22 is a bar-like member that connects the foils 21 at a predetermined interval as shown in FIG. 2.

In the wick structure 5, the structure holding portion 22 which is a rod-like member is fitted into the respective foils 21, 21 . . . at respective corner portions of the foils 21. The structure holding portion 22 includes plural (four in FIG. 2) rod-like members. The foils 21 are positioned and arranged side by side by fitting the structure holding portions 22 as the rod-like members into the respective foils 21, 21 . . . .

The material of the rod-like member is not particularly limited, but from the viewpoint of excellent thermal conductivity, for example, the same material as the foils 21 may be recited. Specifically, for example, metal (that is, metal foils) such as copper and copper alloy, aluminum and aluminum alloy from the viewpoint of lightness, and stainless steel, etc. from the viewpoint of strength can be used. In addition to the foregoing various metals, ceramics (including glass) and carbon materials (for example, graphite, diamond, etc.) from the viewpoint of thermal conductivity can be used as the material of the rod-like member foils 21.

Next, a wick structure according to a sixth embodiment of the present disclosure and a planar type heat pipe (hereinafter may be referred to as "vapor chamber") in which the wick structure according to the sixth embodiment is accommodated will be described with reference to the drawings. First, the vapor chamber in which the wick structure is accommodated will be described.

Figure 8:
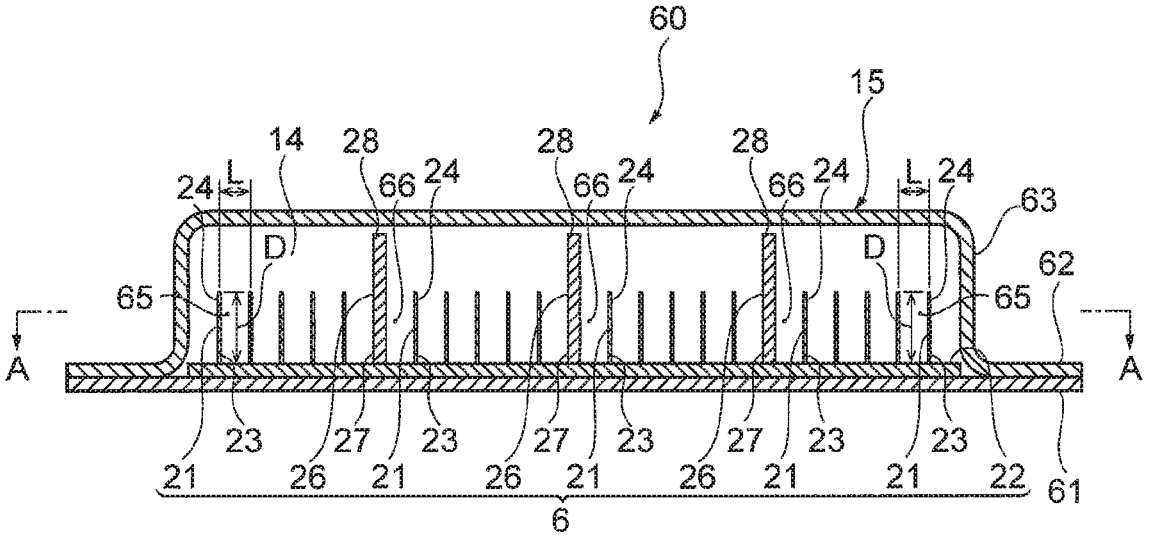
FIG. 8 is a side cross-sectional view of a wick structure according to a sixth embodiment of the present disclosure, which is accommodated in a vapor chamber.
Figure 9:
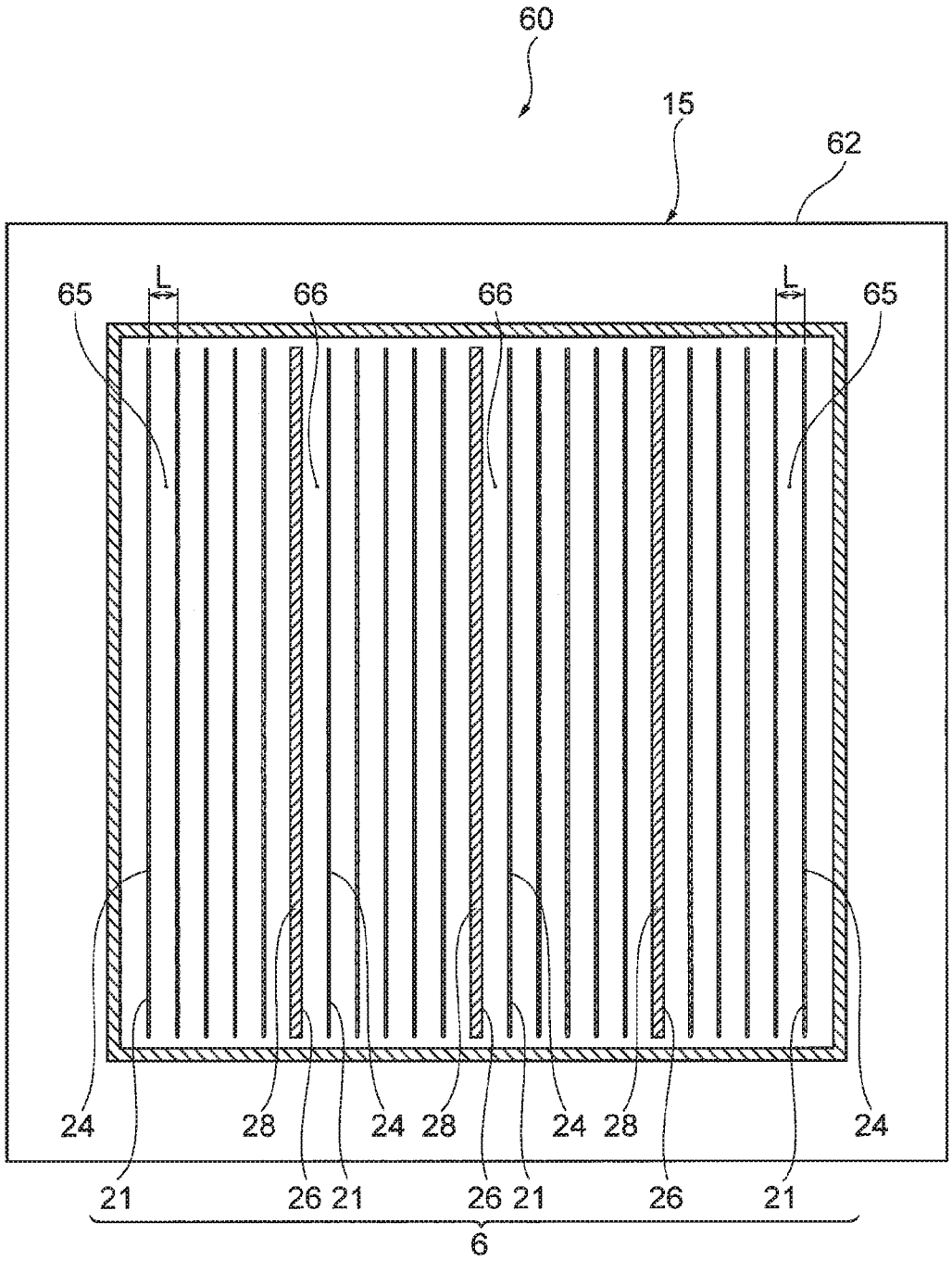
FIG. 9 is a sectional view of A-A of FIG. 8 showing the wick structure according to the sixth embodiment of the present disclosure, which is accommodated in a vapor chamber.

As shown in FIGS. 8 and 9, the wick structure 6 according to the sixth embodiment is accommodated in the container 15 of the vapor chamber 60. The container 15 is a hollow planar type member. A working fluid (not shown) is enclosed inside the container 15.

The container 15 is a sealed member. The container 15 is formed by laminating two opposing plate-like members, that is, one plate-like member 61 and another plate-like member 62 opposite to the one plate-like member 61. The one plate-like member 61 has a flat-plate shape. The other plate-like member 62 also has a flat-plate shape, but a center portion thereof is plastically deformed in a convex shape. A portion of the other plate-like member 62 that protrudes outward and is plastically deformed in a convex shape is a protruding part 63 of the container 15, and the inside of the protruding part 63 is a cavity portion. The cavity portion is depressurized by a degassing treatment. A peripheral edge portion of the one plate-like member 61 and a peripheral edge portion of the other plate-like member 62 are joined to each other, whereby the cavity portion of the container 15 is set to an airtight state. A joining method is not particularly limited, but, for example, brazing, laser welding, resistance joint, pressure welding, etc. can be recited.

The shape of the container 15 in plan view is not particularly limited, but it is a rectangular shape in the case of the vapor chamber 60 as shown in FIG. 9.

The thickness of the container 15 is not particularly limited, but is equal to, for example, 0.5 mm to 2.0 mm. The thicknesses of the one plate-like member 61 and the other plate-like member 62 are not particularly limited, but may be equal to, for example, 0.1 mm, respectively. A heat transport direction of the vapor chamber 60 is a plane direction of the container 15.

As shown in FIG. 8, the wick structure 6 accommodated in the container 15 of the vapor chamber 60 includes plural first foils 21 and a structure holding portion 22 for holding the first foils 21. The respective first foils 21, 21 . . . are held by the structure holding portion 22, whereby the first foils 21 are positioned.

The shape of each of the first foils 21, 21 . . . is a flat rectangular sheet shape (film-like shape). The respective first foils 21, 21 . . . are erected in the vertical direction to the plane direction of the container 15. Furthermore, the respective first foils 21, 21 . . . extend in the vertical direction from the structure holding portion 22. In addition, the respective first foils 21, 21 . . . are arranged side by side at a predetermined interval along the plane direction of the container 15. Therefore, the respective first foils 21, 21 . . . are arranged to be spaced apart from one another.

Furthermore, as shown in FIGS. 8 and 9, in the wick structure 6, a second foil 26 thicker than the first foil 21 is erected between the first foils 21. The wick structure 6 has plural second foils 26. The second foils 26 are positioned by holding the second foils 26 on the structure holding portion 22.

The shape of the second foil 26 is a flat rectangular sheet shape (film-like shape). The second foils 26 are erected in the vertical direction to the plane direction of the container 15. Furthermore, the second foils 26 extend in the vertical direction from the structure holding portion 22. Furthermore, the second foils 26 are arranged among the first foils 21 arranged side by side, and also arranged side by side at a predetermined interval along the plane direction of the container 15. Accordingly, the second foils 26 are arranged side by side at a predetermined interval with respect to the other second foils 26, and also arranged side by side at a predetermined interval with respect to the first foils 21. Plural first foils 21 are erected between the mutually adjacent second foils 26.

Since the container 15 of the vapor chamber 60 is of a planar type, and the thicknesses of one plate-like member 61 and the other plate-like member 62 configuring the container 15 are as thin as about 0.1 mm. Therefore, when the inside of the container 15 is subjected to a degassing treatment and set to a pressure-reduced state, stress directing to the cavity portion occurs in the container 15. However, the wick structure 6 is further provided with the second foils 26 thicker than the first foils 21, so that even when the stress directing to the cavity portion occurs in the container 15, the second foils 26 function as support members for the container 15 to surely prevent deformation and damage of the wick structure 6 accommodated in the container 15. In addition, since the second foils 26 function as the support members, the dimension of the second foils 26 (the height of the second foils 26) in the vertical direction to the plane direction of the container 15 is higher than the dimension of the first foils 21 (the height of the first foils 21) in the vertical direction to the plane direction of the container 15.

In the wick structure 6 of the vapor chamber 60, plural first foils 21, 21 . . . arranged between the adjacent second foils 26 and plural second foils 26 arranged between the second foil 26 and the side surface of the container 15 are arranged at substantially equal intervals at least at the upright base portions erected from the structure holding portion 22. Note that in FIG. 8, the plural first foils 21, 21 . . . arranged between the adjacent second foils 26 and the plural first foils 21, 21 . . . arranged between the second foil 26 and the side face of the container 15 are arranged at substantially equal intervals from the upright base portions erected from the structure holding portion 22 to the free ends which are the tip portions. Furthermore, the plural second foils 26, 26 . . . are also respectively arranged at substantially equal intervals. Furthermore, in the wick structure 6 of the vapor chamber 60, the plural first foils 21, 21 . . . and the plural second foils 26, 26 . . . are arranged side by side substantially in parallel to one another at least at the upright base portions erected from the structure holding portion 22. Note that in FIG. 8, the first foils 21, 21 . . . and the second foils 26, 26 . . . are arranged side by side substantially in parallel to one another from the upright base portions erected from the structure holding portion 22 to the free ends which are the tip portions.

As described above, since the first foils 21 thinner than the second foils 26 are erected in the vertical direction to the plane direction of the container 15, the first foils 21 cannot maintain flat shapes thereof, and thus the shapes in the vertical direction may be deformed such that bent portions are formed at some of the first foils 21. Therefore, the first foils 21 may be close to or contact adjacent other first foils 21 or adjacent second foils 26 at the free end side portions thereof at a shorter distance than the interval between the upright base portions erected from the structure holding portion 22.

From the configurations of the first foils 21 and the second foils 26 described above, the first foils 21, 21 . . . and the second foils 26, 26 . . . are embodied to extend along the plane direction of the container 15, respectively, as shown in FIG. 9. In the vapor chamber 60, the first foils 21 and the second foils 26 of the wick structure 6 are arranged over the center portion of the container 15 and the vicinity thereof, and the wick structure 6 is not arranged at the peripheral portion of the container 15.

As shown in FIG. 8, each of the first foils 21, 21 . . . is positioned by holding one end side portion 23 in the height direction on the structure holding portion 22. Accordingly, one end side portion 23 of the first foil 21 serves as the upright base portion erected from the structure holding portion 22. That is, the respective first foils 21, 21 . . . are embodied to be erected from the structure holding portion 22, and the respective first foils 21, 21 . . . are mutually connected to one another via the structure holding portion 22.

Like the first foils 21, the respective second foils 26, 26 . . . are also positioned by holding one end side portions 27 thereof in the height direction on the structure holding portion 22. Accordingly, the one end side portions 27 of the second foils 26 serve as upright base portions erected from the structure holding portion 22. That is, the respective second foils 26, 26 . . . are embodied to be erected from the structure holding portion 22, and the respective second foils 26, 26 . . . are mutually connected to one another via the structure holding portion 22, and further mutually connected to the first foils 21, 21 . . . via the structure holding portion 22.

On the other hand, other end side portions 24 opposite to the one end side portions 23 of the first foils 21 are not fixed, but serve as free ends. In the wick structure 6, the tips of the other end side portions 24 of the first foils 21 do not contact the inner surface of the container 15. Like the first foils 21, other end side portions 28 opposite to the one end side portions 27 of the second foils 26 are not fixed, but serve as free ends. Accordingly, a space between the other end side portions 24 of the mutually adjacent first foils 21 serves as an opened portion, and a space between the other end side portion 28 of the second foil 26 and the other end side portion 24 of the first foil 21 adjacent to the second foil 26 also serves as an opened portion.

From the foregoing, a first groove portion 65 which is a gap portion is formed between the mutually adjacent first foils 21. Since the surface shape of the first foil 21 is flat, that is, planar, the cross-sectional shape of the first groove portion 65 in a direction orthogonal to the planar direction of the vapor chamber 60 is rectangular. Furthermore, the first groove portion 65 extends along the plane direction of the vapor chamber 60 between the mutually adjacent first foils 21. In addition, the surface of the structure holding portion 22 corresponds to bottom portions of the first groove portions 65. Accordingly, the depth (D) of the first groove portion 65 corresponds to the distance from the surface of the structure holding portion 22 to the other end side portion 24 of the first foil 21.

Furthermore, a second groove portion 66 which is a gap portion is formed between the second foil 26 and the first foil 21 adjacent to the second foil 26. Since the surface shape of the second foil 26 is flat, that is, planar, the cross-sectional shape of the second groove portion 66 in a direction orthogonal to the plane direction of the vapor chamber 60 is rectangular. Furthermore, the second groove portion 66 extends along the plane direction of the vapor chamber 60 between the second foil 26 and the first foil 21 adjacent to the second foil 26.

In the wick structure 6, the side of the other end side portion 24 of the first foil 21 serves as the opened portion, and also the cross-sectional shape of the first groove portion 65 is a rectangular, so that the working fluid which has changed in phase from the liquid phase to the gas phase in the first groove portion 65 is smoothly discharged from the first groove portion 65 to the outside of the wick structure 6 via the opened portion between the other end side portions 24. In addition, in the wick structure 6, the side of the other end side portion 28 of the second foil 26 also serves as an opened portion, and also the cross-sectional shape of the second groove portion 66 is rectangular, so that the working fluid which has changed in phase from the liquid phase to the gas phase in the second groove portion 66 is smoothly discharged from the second groove portion 66 to the outside of the wick structure 6 via the opened portion between the other end side portion 24 and the other end side portion 28. Accordingly, when the working fluid having changed in phase from the liquid phase to the gas phase in the first groove portion 65 and the second groove portion 66 is discharged to the outside of the wick structure 6, the pressure loss can be reduced, and further flow of the gas-phase working fluid in the container 15 can be smoothened.

In the wick structure 6, the aspect ratio of the plural first foils 21, 21 . . . is not particularly limited, but the plural first foils 21, 21 . . . are arranged so that the aspect ratio is not less than 2 and not more than 1000, for example. As described above, the "aspect ratio" means the ratio of the height (D) of the first foil 21 formed therebetween the mutually adjacent first foils 21 relative to the thickness (T) of the foil at the upright base portions (one end side portions 23) of the mutually adjacent first foils 21 (the height (D) of the first foil/the thickness (T) of the first foil). Note that as shown in FIG. 8, the foil pitch (L) is a distance between one surface of one foil 21 and a surface of another foil 21 adjacent to the one foil 21, which does not face the one foil 21. The plural foils 21, 21 . . . are arranged so that the aspect ratio is not less than 2 and not more than 1000, whereby the pressure loss of the working fluid flowing through the wick structure 6 can be further reduced while enhancing the capillary force. In addition, the wick structure 6 is accommodated in the container 15, whereby it is possible to obtain the vapor chamber 60 exhibiting an excellent heat transport characteristic. Note that when deformation occurs in the shapes of foils 21 of the wick structure 6 because the sheet-shaped (film-like) first foils 21 are erected upright and thus cannot maintain flat shapes, so that the foils 21 have bent portions or the like, the foregoing aspect ratio is calculated on the assumption of a shape from which the deformation is eliminated.

As described above, the aspect ratio of the first foil 21 is, for example, not less than 2 and not more than 1000. However, with respect to the lower limit value of the aspect ratio, from the viewpoint of further enhancing the capillary force of the wick structure 1 to smoothen the reflux of the liquid-phase working fluid, 70 is more preferable, 80 is further preferable, and 90 is particularly preferable. In addition, with respect to the upper limit value of the aspect ratio of the first foils 21, from the viewpoint of surely reducing the pressure loss when the working fluid having changed in phase from the liquid phase to the gas phase flows through the wick structure 1, 480 is more preferable, and 330 is particularly preferable.

Furthermore, the aspect ratio of the first foils 21 may be the same aspect ratio or different aspect ratios among the respective first foils 21, 21 . . . .

The arithmetic average roughness (Ra) of the surfaces of the first foils 21 and the second foils 26 is not particularly limited, and the surfaces may be smooth surfaces. However, with respect to the lower limit value of the arithmetic average roughness (Ra), from the viewpoint of the contribution to the enhancement of the capillary force, 0.01 μm is preferable, and 0.02 μm is particularly preferable. On the other hand, the upper limit values of the arithmetic average roughness (Ra) of the surfaces of the first foils 21 and the second foils 26 are not particularly limited, but from the viewpoint of the smooth flow of the working fluid in the gas phase, 1.0 μm is preferable, and 0.5 μm is particularly preferable.

Furthermore, the wick structure 6 is embodied so that the thickness of the second foils 26 is larger than the thickness of the first foils 21. The thickness of the second foils 26 is not particularly limited as long as the wick structure 6 is embodied so that the thickness of the second foils 26 is larger than the thickness of the first foils 21. However, with respect to the lower limit value of the thickness of the second foils 26, from the viewpoint of surely obtaining a function as the support member, for example, 35 μm is preferable, and 40 μm is particularly preferable. On the other hand, with respect to the upper limit value of the thickness of the second foils 26, from the viewpoint of smooth flow of the gas-phase working fluid, 300 μm is preferable, and 200 μm is particularly preferable. Furthermore, with respect to the lower limit value of the thickness of the first foils 21, from the viewpoint of mechanical strength, for example, 1 μm is preferable, and 2 μm is particularly preferable. On the other hand, with respect to the upper limit value of the thickness of the first foils 21, from the viewpoint of enhancing the aspect ratio while ensuring the widths of the first groove portions 35, 30 μm is preferable, and 25 μm is particularly preferable. Also, when the thickness of the first foils 21 is equal to 6 μm or less, excellent handling performance cannot be obtained, but from the viewpoint of enhancing the capillary force of the wick structure 6, it is preferable that the thickness of the first foils 21 is small.

The height of the first foils 21 is not particularly limited, but from the viewpoint of smoothly refluxing the liquid-phase working fluid from the heat radiating portion to the heat receiving portion, it is preferable that the height of the first foils 21 is equal to 10% or more of the dimension in the vertical direction to the plane direction of the cavity portion of the container 15, and it is particularly preferable that the height of the first foils 21 is equal to 20% or more. On the other hand, from the viewpoint of causing the working fluid having changed in phase from the liquid phase to the gas phase in the wick structure 1 to smoothly flow from the heat receiving portion to the heat radiating portion, it is preferable that the height of the first foils 21 is equal to 90% or less of the dimension in the vertical direction to the plane direction of the cavity portion of the container 15, and it is particularly preferable that the height of the first foils 21 is equal to 80% or less.

The foil pitch (L) at the upright base portions (the one end side portions 23) of the mutually adjacent first foils 21 erected from the structure holding portion 22 can be appropriately set according to the aspect ratio of the plural first foils 21, 21 . . . . However, with respect to the lower limit value of the foil pitch (L), 2 μm is preferable, 10 μm is more preferable, and 20 μm is particularly preferable from the viewpoint of obtaining flowability of the working fluid by ensuring the width of the first groove portions 65 (that is, the distance between the mutually adjacent first foils 21), that is, surely reducing the pressure loss. On the other hand, with respect to the upper limit value of the foil pitch (L), 100 μm is preferable, and 80 μm is particularly preferable from the viewpoint of surely preventing reduction of the capillary force.

The material of the first foils 21 is not particularly limited, and for example, metal (that is, metal foil) such as copper and copper alloy from the viewpoint of excellent thermal conductivity, aluminum and aluminum alloy from the viewpoint of lightness, and stainless steel from the viewpoint of strength can also be used. Furthermore, in addition to the foregoing various metals, ceramics (including glass) and carbon materials (for example, graphite, diamond, etc.) from the viewpoint of thermal conductivity can be used. The material of the second foils 26 is not particularly limited, and, for example, like the first foils 21, metal (that is, metal foil) such as copper and copper alloy from the viewpoint of excellent thermal conductivity, aluminum and aluminum alloy from the viewpoint of lightness, and stainless steel from the viewpoint of strength can be used. Metal having no penetration hole, a porous material such as metal having plural penetration holes, a metal mesh, and the like are recited as examples of the metal foils used as the second foils 26. In addition to the above various metals, ceramics (including glass) and carbon materials (for example, graphite, diamond, etc.) from the viewpoint of thermal conductivity can be used as the material of the second foils 26. The material of the first foils 21 and the material of the second foils 26 may be the same or different from each other. Furthermore, metal (copper, copper alloy, etc.), ceramics, carbon materials can be recited as the material of the structure holding portion 22.

The material of the container 15 is not particularly limited, but for example, copper and copper alloy from the viewpoint of excellent thermal conductivity, aluminum and aluminum alloy from the viewpoint of lightness, and stainless steel, etc. from the viewpoint of strength can be used. In addition, tin, tin alloy, titanium, titanium alloy, nickel, nickel alloy, etc. may be used according to a use condition. The working fluid to be enclosed in the container 15 can be appropriately selected according to compatibility with the material of the container 15, and for example, water, substitute CFCs, perfluorocarbon, cyclopentane and the like can be recited.

Next, a mechanism of heat transport of the vapor chamber 60 in which the wick structure 6 according to the sixth embodiment of the present disclosure is accommodated will be described with reference to FIGS. 8 and 9. Description will be made by exemplifying a case where the center portion of the container 15 at which the wick structure 6 is arranged serves as a heat receiving portion and the peripheral portion of the container 15 serves as a heat radiating portion.

First, a heat-generating element (not shown) is thermally connected to a side of the outer surface of the container 15 on which the structure holding portion 22 of the wick structure 6 is arranged. The structure holding portion 22 of the wick structure 6 contacts the inner surface of the container 15. When the vapor chamber 60 receives heat from the heat-generating element at the heat receiving portion, the heat is transferred from the container 15 of the vapor chamber 60 to the structure holding portion 22 of the wick structure 6. The heat transferred to the structure holding portion 22 is transferred from the structure holding portion 22 to the first foils 21 and the second foils 26, and the liquid-phase working fluid changes in phase to the gas phase inside the wick structure 6 (the first groove portions 65 and the second groove portions 66). The working fluid which has changed in phase to the gas phase in the first groove portions 65 and the second groove portions 66 of the wick structure 6 drifts upward in the gravitational direction (the direction from the upright base portions of the foils to the other end side portions of the foils). The gas-phase working fluid drifted upward in the gravitational direction is released from the first groove portions 65 and the second groove portions 66 to the outside of the wick structure 6 via each opened portion formed between the other end side portions 24 of the mutually adjacent first foils 21 and each opened portion formed between the other end side portion 24 of the first foil 21 and the other end portion 28 of the second foil 26. The internal space of the container 15 functions as a vapor flow path 14 through which the gas-phase working fluid flows. The gas-phase working fluid discharged to the outside of the wick structure 6 flows from the heat receiving portion (center portion) to the heat radiating portion (peripheral edge portion) in the plane direction of the container 15 in the vapor flow path 14, whereby the heat from the heat-generating element is transferred from the heat receiving portion to the heat radiating portion. The heat from the heat-generating element which is transferred from the heat receiving portion to the heat radiating portion is released as latent heat by the gas-phase working fluid changing in phase to the liquid phase at the heat radiating portion which is provided with heat exchanging means as required. The latent heat released at the heat radiating portion is released from the heat radiating portion to an external environment of the vapor chamber 60. The working fluid which has changed in phase from the gas phase to the liquid phase at the heat radiating portion is taken into, for example, wick portions (not shown) such as plural slender grooves provided on the inner surface of the container 15, and returned from the heat radiating portion to the heat receiving portion by capillary force of the wick portions.

In the wick structure 6 according to the sixth embodiment, the plural first foils 21, 21 . . . are arranged so as to be spaced apart from one another, so that the wick structure 6 can reduce the pressure loss of the working fluid flowing in the wick structure 6 without impairing the capillary force. Accordingly, the wick structure 6 is excellent in flowability of the gas-phase working fluid inside the wick structure 6 while maintaining the reflux characteristic of the liquid-phase working fluid from the heat radiating portion to the heat receiving portion. Therefore, the wick structure 6 is accommodated inside the container 15, which makes it possible to obtain the vapor chamber 60 exhibiting an excellent heat transport characteristic. Furthermore, even when a stress occurs in a direction to the inside of the container 15 because the inside of the planar container 15 is set to a pressure-reduced state, the second foils 26 function as the support members, so that it is possible to surely prevent deformation and damage of the wick structure 6 accommodated in the container 15, and an excellent heat transport characteristic can be maintained for a long time.

Since the first foils 21 used in the wick structure 6 are sheet-like members, the wick structure 6 is structurally excellent in thermal conductivity as compared with a wick structure including a mesh member having fine voids and a sintered body of metal powder or the like. Accordingly, the thermal conductivity from the heat-generating element to the wick structure 6 is excellent, and also the thermal conductivity from the wick structure 6 to the outside is excellent, so that the heat transport characteristic of the vapor chamber 60 is enhanced.

Next, an example of a method for manufacturing the wick structure 6 according to the sixth embodiment of the present disclosure will be described. The method of manufacturing the wick structure 6 can manufacture the wick structure 6 by, for example, a 3D printer or metal powder molding. A solution photocuring lamination method, a melting lamination method, a material extrusion photocuring method, a powder bed melting bonding method, or the like may be adopted for the 3D printer.

Next, a wick structure according to a seventh embodiment of the present disclosure will be described. Description will be made by using the same reference signs with respect to the same components as those of the wick structures according to the first to sixth embodiments are denoted by the same reference numerals.

Figure 10:
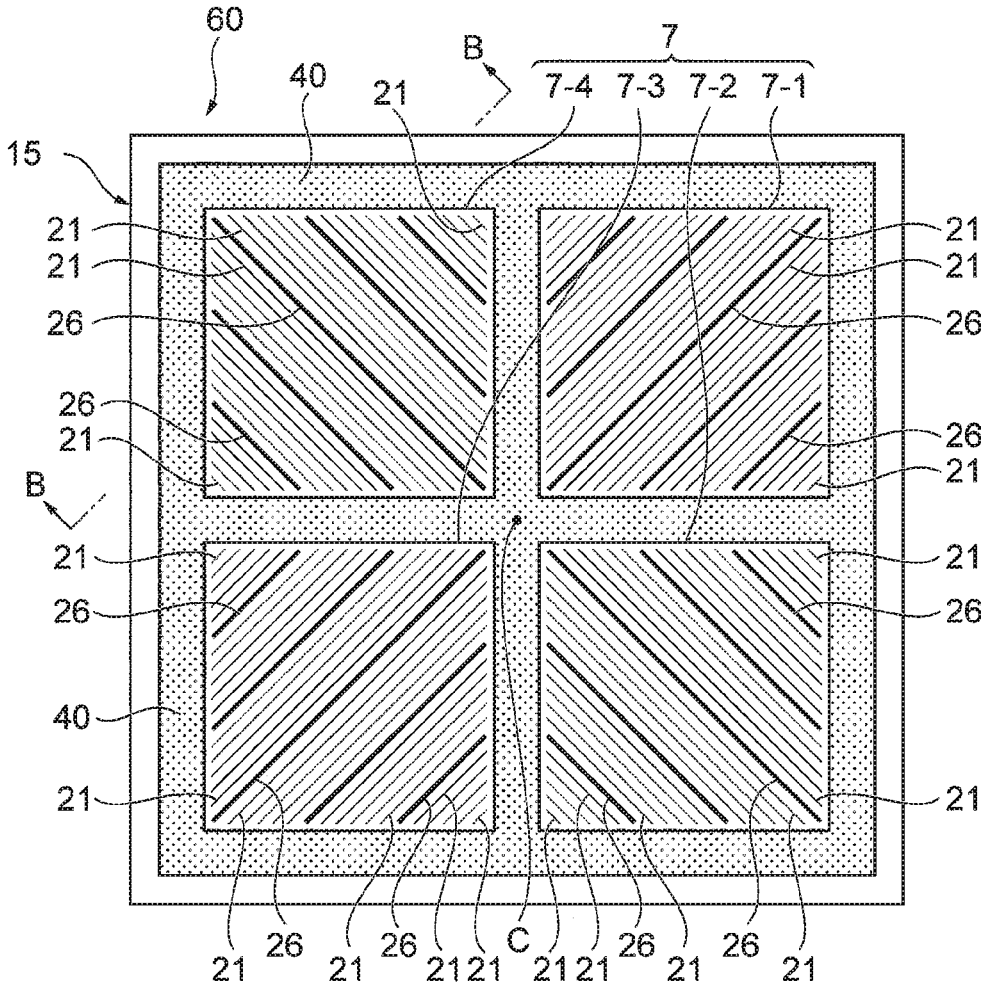
FIG. 10 is a plan cross-sectional view of a wick structure according to a seventh embodiment of the present disclosure, which is accommodated in a vapor chamber.

In the wick structure 6 according to the sixth embodiment, both the first foils 21 and the second foils 26 are all arranged side by side substantially in parallel to one another. However, in place of this arrangement, as shown in FIG. 10, in the wick structure 7 according to the seventh embodiment, the surfaces of the first foils 21 in a predetermined area extend in a direction which is not parallel to the surfaces of the first foils 21 in another predetermined area. Furthermore, the surfaces of the second foils 26 in the predetermined area extend in a direction which is not parallel to the surfaces of the second foils 26 in the other predetermined area. In the wick structure 7, the surfaces of the first foils 21 and the surfaces of the second foils 26 are arranged so as to extend to a center C of the cavity portion of the container 15.

The wick structure 7 is sectioned into plural areas (in FIG. 10, four areas of areas 7-1, 7-2, 7-3, 7-4) so that the cavity portion of the container 15 having a substantially square shape in plan view is equally divided. The surfaces of the first foils 21 and the surfaces of the second foils 26 erected in the area 7-1 extend in a direction which is substantially parallel to the surfaces of the first foils 21 and the surfaces of the second foils 26 erected in the area 7-3 which is in a position symmetrical with the center C. On the other hand, the surfaces of the first foils 21 and the surfaces of the second foils 26 erected the area 7-1 and the area 7-3 extend in a direction which is not parallel (a direction of about 90° in FIG. 10) to the surfaces of the first foils 21 and the surfaces of the second foils 26 erected in the area 7-2 and the area 7-4 which are not in a position symmetrical with the center C. Furthermore, the surfaces of the first foils 21 and the surfaces of the second foils 26 erected in the area 7-2 extend in a direction which is substantially parallel to the surfaces of the first foils 21 and the surfaces of the second foils 26 erected in the area 7-4 which is in a position symmetrical with the center C.

In the wick structure 7, diffusion of the working fluid having changed in phase from the liquid phase to the gas phase from the center C of the cavity portion of the container 15 is made uniform in the plane direction of the vapor chamber 60. Furthermore, reflux of the working fluid having changed in phase from the gas phase to the liquid phase to the center C of the cavity portion of the container 15 is smoothed in the wick structure 7. Accordingly, when the heat-generating element is thermally connected to the center C of the container 15 or the vicinity thereof, the heat transport characteristic of the vapor chamber 60 is further enhanced.

Figure 11:
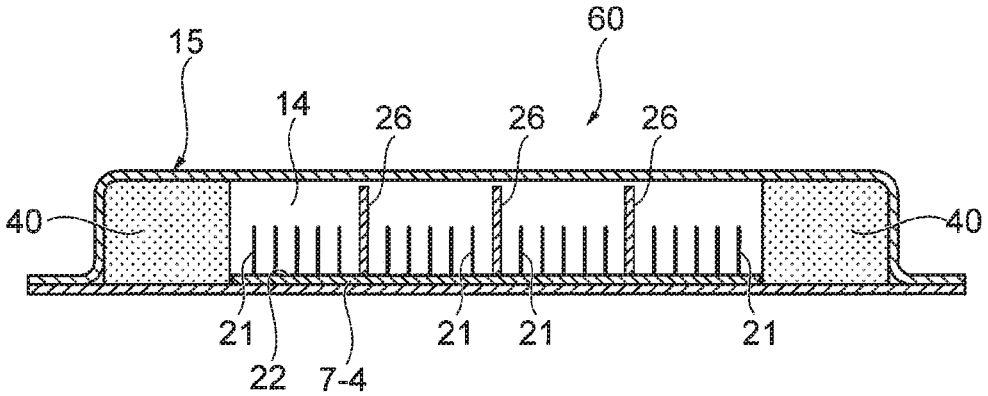
FIG. 11 is a cross-sectional view of B-B of FIG. 10 showing the wick structure according to the seventh embodiment of the present disclosure, which is accommodated in a vapor chamber.

As shown in FIGS. 10 and 11, in the wick structure 7, wick portions 40 each having capillary force are provided around the areas 7-1, 7-2, 7-3, and 7-4. As the wick portion 40 may be recited, for example, a metal mesh, a sintered body of metal powder, or the like. By providing the wick portions 40, the working fluid is smoothly supplied to the first foil 21 of the area 7-1, the area 7-2, the area 7-3, and the area 7-4.

In the wick structures 6 and 7 according to the sixth and seventh embodiments, if necessary, foil support portions similar to the foregoing foil support portions may be formed along the upright base portions of the first foils 21 and the second foils 26. The foil support portion has, for example, a convex shape. By providing the foil support portions 30, the first foils 21 and the second foils 26 are stably held by the structure holding portion 22.

In the wick structures 6 and 7 according to the sixth and seventh embodiments, if necessary, mesh materials of metal, sintered bodies of metal powder, sintered bodies of metal short fibers, porous structures such as porous metal which are similar to the materials described above may be provided between the mutually adjacent foils 21, and between the second foil 26 and the first foil 21 adjacent to the second foil 26. A porous structure may be provided on the surface of the structure holding portion 22. Accordingly, the gap portions forming the first groove portions 65 and the second groove portions 66 are maintained. The porous structure is provided, so that the capillary force and the heat transfer characteristic of the wick structures 6 and 7 are more enhanced.

Next, a wick structure according to another embodiment of the present disclosure will be described. In the wick structures of the sixth and seventh embodiments, the second foils 26 functioning as the support members are provided, but the second foils 26 may not be provided according to the use condition of the wick structure or the like. Furthermore, in the wick structures according to the sixth and seventh embodiments, the first foils 21 and the second foils 26 are all arranged at substantially equal intervals, but instead of this arrangement, the first foils 21 and the second foils 26 may be arranged at different intervals.

The wick structures of the sixth and seventh embodiments are embodied so that the structure holding portion 22 directly contacts the inner surface of the container 15, but, if necessary, a sintered body of metal powder such as copper powder, silver solder, solder or the like may be interposed between the structure holding portion 22 and the inner surface of the container 15. In this case, the structure holding portion 22 is fixed to the inner surface of the container 15 by the sintered body of metal powder such as copper powder, the silver solder, the solder or the like, and finally the wick structure 1 is fixed to the inner surface of the container 15 by the sintered body of metal powder such as copper powder, the silver solder, the solder or the like. Since the sintered body of metal powder such as copper powder has capillary force, it also functions as a wick portion for refluxing the liquid-phase working fluid to the position of the wick structure 1.

Since the wick structure of the present disclosure can reduce the pressure loss of the flowing working fluid without impairing the capillary force, it has a high utility value, for example, in the field of heat pipes for cooling electronic parts and the like having a high calorific value.

What is claimed is:

1. A wick structure to be accommodated inside a container of a heat pipe, the wick structure including a plurality of foils that are erected so as to be opposite to one another, wherein an aspect ratio of the plurality of foils is not less than 2 and not more than 1000, wherein the wick structure is arranged at one end portion of the container, and there is no other wick structure arranged at a center portion of the container and at another end portion opposite the one end portion, and wherein one end portion of the container having the wick structure arranged therein is a heat receiving portion and the other end portion is a heat radiating portion.

2. The wick structure according to claim 1, wherein the plurality of foils are arranged side by side, and held by at least one structure holding portion, and the plurality of foils are connected via the structure holding portion.

3. The wick structure according to claim 1, wherein a structure holding portion may function as a fixing portion for connecting and fixing the plurality of foils to an inner surface of the container.

4. The wick structure according to claim 1, wherein foil support portions are formed at upright base portions of the foils.

5. The wick structure according to claim 1, wherein a porous member is provided to a part between the foils that are mutually adjacent to each other.

6. The wick structure according to claim 1, wherein a material of the foils is metal, ceramics or carbon.

7. The wick structure according to claim 1, wherein an arithmetic average roughness (Ra) of surfaces of the foils is not less than 0.01 μm and not more than 1 μm.

8. The wick structure according to claim 1, wherein thicknesses of the foils are not less than 1 μm and not more than 300 μm.

9. The wick structure according to claim 1, wherein an inter-foil distance between two adjacent foils at upright base portions of the foils is not less than 2 μm and not more than 300 μm.

10. The wick structure according to claim 1, wherein a cross-sectional area of the wick structure in a vertical direction to a longitudinal direction of the container is equal to 10% to 90% of a cross-sectional area of the container in the vertical direction to the longitudinal direction of the container.

11. The wick structure according to claim 3, wherein the fixing portion is a sintered body of metal powder, silver solder, or solder.

12. A heat pipe in which the wick structure according to claim 1 is accommodated.

13. The heat pipe according to claim 12, wherein the wick structure is installed at a heat receiving portion.

14. The wick structure according to claim 2, wherein the plurality of foils have first foils and second foils thicker than the first foils, a dimension of the second foils in a vertical direction to a plane direction of the container is higher than a dimension of the first foils in the vertical direction to the plane direction of the container, the second foils function as support members for the container, and the first foils and the second foils are arranged side by side in parallel to one another from upright base portions erected from the structure holding portion to the free ends which are the tip portions, or the first foils are close to or contact adjacent other first foils or adjacent second foils at the free end side portions thereof at a shorter distance than the interval between the upright base portions erected from the structure holding portion.

* * * * *